US006769854B2

(12) United States Patent
Wolf et al.

(10) Patent No.: US 6,769,854 B2
(45) Date of Patent: Aug. 3, 2004

(54) ARRANGEMENT FOR EXCHANGE OF EMPTY BOBBINS WITH FULL BOBBINS IN A BOBBIN CREEL

(75) Inventors: Jörg Wolf, Neuenhaus (DE); Bernd Keen, Nordhorn (DE)

(73) Assignee: Neuenhauser Maschinenbau GmbH & Co. KG, Neuenhaus (DE)

( * ) Notice: Subject to any disclaimer, the term of this patent is extended or adjusted under 35 U.S.C. 154(b) by 96 days.

(21) Appl. No.: 10/037,320

(22) Filed: Jan. 3, 2002

(65) Prior Publication Data

US 2002/0098065 A1 Jul. 25, 2002

(30) Foreign Application Priority Data

Jan. 10, 2001 (DE) ..... 101 00 764

(51) Int. Cl.[7] ..... D01H 9/10

(52) U.S. Cl. ..... 414/331.6; 57/281; 242/559; 242/559.4; 414/416.3; 414/416.8; 414/910

(58) Field of Search ..... 242/559, 399.3, 242/559.4, 473.4–474.2; 57/281; 414/331.6, 331.7, 416.3, 416.8, 911, 910

(56) References Cited

U.S. PATENT DOCUMENTS

| | | | | | |
|---|---|---|---|---|---|
| 3,729,915 | A | * | 5/1973 | Mayer et al. | 57/271 |
| 3,854,275 | A | * | 12/1974 | Bethea et al. | 57/281 |
| 4,023,339 | A | * | 5/1977 | Laderach et al. | 57/268 |
| 4,515,328 | A | * | 5/1985 | Payne, Jr. | 242/131 |
| 4,783,021 | A | * | 11/1988 | Nagasawa | 242/131.1 |
| 4,805,352 | A | * | 2/1989 | Grassle et al. | 57/267 |
| 4,841,720 | A | * | 6/1989 | Kawasaki et al. | 57/281 |
| 4,899,531 | A | * | 2/1990 | Mack | 57/281 |
| 4,979,360 | A | * | 12/1990 | Kallmann et al. | 57/281 |
| 5,099,641 | A | * | 3/1992 | Igel et al. | 57/281 |
| 5,169,273 | A | * | 12/1992 | Kawamura | 414/331.04 |
| 5,316,126 | A | * | 5/1994 | Hirai | 198/468.6 |
| 5,365,728 | A | * | 11/1994 | Mack | 57/281 |
| 6,263,653 | B1 | * | 7/2001 | Mack | 57/281 |

FOREIGN PATENT DOCUMENTS

| | | | |
|---|---|---|---|
| DE | 39 41 822 | * | 6/1991 |
| DE | 91 08 079 U1 | | 10/1991 |
| DE | 91 11 871 U1 | | 1/1993 |
| EP | 0 678 469 A2 | | 10/1995 |

* cited by examiner

*Primary Examiner*—Thomas J. Brahan
(74) *Attorney, Agent, or Firm*—Henry M. Feiereisen; Ursula B. Day

(57) ABSTRACT

An arrangement for exchanging empty bobbins with full bobbins includes a creel having lateral delivery positions for holding filament-carrying bobbins for delivery of filaments to a textile machine. Disposed above the creel is a bobbin carrier which has several transport positions for bobbins and is moveably guided in a rail for travel in suspended disposition along a travel path. Transfer units are positioned on either side of the creel for transferring bobbins between the creel and the bobbin carrier and include an upright moveable along the creel and at least one support moveable along the upright and having receptacles for the bobbins. The receptacles are moveable horizontally relative to the support, wherein the delivery positions of the creel that neighbor the transfer unit are provided at a number and at a distance which corresponds to a number of and a vertical distance of the transport positions on the bobbin carrier.

9 Claims, 5 Drawing Sheets

ARRANGEMENT FOR EXCHANGE OF EMPTY BOBBINS WITH FULL BOBBINS IN A BOBBIN CREEL

CROSS-REFERENCES TO RELATED APPLICATIONS

This application claims the priority of German Patent Application, Serial No. 101 00 764.7, filed Jan. 10, 2001, the subject matter of which is incorporated herein by reference.

BACKGROUND OF THE INVENTION

The present invention relates to an arrangement for exchange of empty bobbins with full filament-carrying bobbins in a bobbin creel which cooperates with a textile machine for processing filaments (yarns or threads) from the bobbin creel.

Bobbin creels are intended for delivery of filaments from bobbins to a filament-processing textile machine, e.g., a beamer, and include several rows of creels in parallel relationship. Normally, each creel row has delivery positions for the bobbins on both sides. For example, the creel row may have ninety delivery positions in the horizontal in side-by-side disposition and six positions in vertical superimposed disposition. Common bobbin creels have three creel rows so that a total of 3240 delivery positions for the bobbins are provided.

The bobbins are readied, e.g., in boxes, for use in the creel. A box contains typically thirty bobbins. Heretofore, an operator oftentimes takes full bobbins from the box in the area of the creel and transfers them manually to the various delivery positions. Bobbins of a diameter of about 240 mm can have a weight of 9 to 10 kg so that the physical stress on the operator is significant when carrying out the transfer of full bobbins. In cases that involve even greater bobbin diameters and therefore greater weights, the physical stress may become extreme enough to violate worker's protection rules.

When further considering that the so-called doffing time, i.e. the time spent for changing a bobbin including shutdown period of the textile machine, time for cutting the yarns, removing empty bobbins, positioning new bobbins, connecting the yarns, and re-starting of the textile machine, is about 30 hours, which means about 33 seconds per bobbin in a creel of 3240 bobbins, and that the actual bobbin operation is about 24 hours for a bobbin diameter of about 240 mm, it is evident that the overall operation is not viable in an economic sense.

European Pat. No. EP 0 678 469 A2 describes an arrangement with a feed device for bobbin creels having modules for executing particular functions. The modules are all placed at ground level and travel at that level. The feed device includes an endless conveyor which extends in a vertical direction and is trained about pulleys which rotate about horizontal axes. The endless conveyor is provided with transport spikes extending transversely to the conveyor and intended for receiving individual yarn-carrying bobbins which are loaded by hand. After placement of the bobbins onto a transport spike, the individual bobbins are moved by the endless conveyor until all transport spikes have received yarn-carrying bobbins. Subsequently, the feed device travels transversely to the creel until positioned in front of a bobbin carriage which is provided with a spike carrier for carriage spikes. The spike carrier is so configured as to allow a limited travel in a vertical direction in order to compensate differences in height between a carriage spike, a transport spike and a creel spike in the respectively lowermost positions.

A transfer of the yarn-carrying bobbins from the feed device to the spikes of the bobbin carriage is implemented in a region which is at a significant distance away from a bobbin transfer position between the carriage and the creel. Therefore, the demand on space for the feed device and the carriage is significant in horizontal plane in circumferential direction of the creel. In addition, the transport spikes of the endless conveyor must be loaded with full yarn-carrying bobbins by hand in the area of the feed device. As a result, there is added need for space for the worker as well as transport of full bobbins. This drawback in conjunction with the space demand is further compounded when considering that typical creel assemblies have several rows of creels in side-by-side disposition and when considering the length of each creel row. Therefore, a bobbin carriage has to be moved into a front area of a creel when being loaded with full bobbins.

German Pat. No. DE 91 11 871 U1 discloses an extremely complicated overhead carriage which is made of many components. The carriage is suspended from rails and travels in a direction perpendicular to the transport direction of a delivery conveyor. Rotatably connected to the carriage via a vertical shaft is a rail for guiding a running gear having a mounting for spikes projecting out from both sides. These spikes cooperate with spikes of an intermediate conveyor having a revolving belt.

German Pat. No. DE 91 09 079 U1 discloses an apparatus for supplying a bobbin carriage of a creel.

It would be desirable and advantageous to provide an improved arrangement for exchange of empty bobbins with full bobbins in a bobbin creel, which obviates prior art shortcomings and which is much less strenuous to an operator while still significantly enhancing the overall efficiency.

SUMMARY OF THE INVENTION

According to one aspect of the present invention, an arrangement for exchanging empty bobbins with full bobbins includes a creel assembly including rows of creels which have lateral delivery positions configured for holding filament-carrying bobbins, a textile machine receiving filament from the creel assembly, at least one bobbin carrier disposed in overhead relationship to the creel assembly and having several transport positions for bobbins, a guide system having a guide rail for travel of the bobbin carrier in suspended disposition along a travel path, a bobbin transfer assembly having a moveable transfer unit disposed on one side of the creel row and a moveable transfer unit disposed on the other side of the creel row, each of the transfer units including an upright moveable along the creel row and at least one support moveable along the upright and having receptacles for the bobbins, wherein the receptacles are moveable in a horizontal direction with respect to the support, wherein the delivery positions in the creel row in neighboring disposition to the transfer unit are provided at a number and at a distance which corresponds to a number of and a vertical distance of the transport positions on the bobbin carrier, a feed station disposed in the travel path for supply of full bobbins, a storage station disposed in the travel path for storing carrier bobbins loaded with full bobbins, and a cleaning station for cleaning empty bobbins.

The present invention resolves prior art problems by the provision of at least one bobbin carrier configured in dependence on the size of the respective bobbin creel and arranged in the area of the creel above a creel row and suspended from a guide rail for travel along a predetermined path. Oscillating movements are hereby eliminated. The exact positioning of the carrier above a creel row is significantly enhanced.

The use of such a bobbin carrier allows transport of full bobbins to the delivery positions of a creel row and removal of empty bobbins, i.e., bobbin cases, from the creel row for transfer to a renewed bobbin production, i.e., loading the empty bobbin with filaments. The exchange of empty bobbins with full bobbins can be realized by initially transporting the bobbin cases away by means of a carrier and subsequently transferring full bobbins from another, respectively loaded, carrier onto the empty delivery positions. Of course, it is also conceivable, to move a bobbin carrier with an array of empty transport positions onto the bobbin cases and subsequent placement of full bobbins from this bobbin carrier onto the empty delivery positions of a creel row. As a consequence, parallel, overlapping or sequential exchange operations can be carried out.

The transfer of the bobbin cases from the delivery positions onto the transport positions of a bobbin carrier, or the transfer of full bobbins from the transport positions of a carrier onto the delivery positions, is implemented by the transfer unit which can be operated by hand or automatically, e.g. in response to a memory-programmable control system. In case of an automatic control, the transfer unit and/or a bobbin carrier and/or a creel row may include sensors to ensure that the receptacles of the transfer devices are positioned in a precise location relative to the delivery positions of one creel row, on the one hand, and the transport positions of a bobbin carrier, on the other hand.

The support of a transfer device may, for example, be realized by a strip that is guided by the upright. The receptacles may be made of pins that are suited to the inner diameter of the bobbin cases. Shift of a support may be implemented pneumatically, electrically or also hydraulically.

An upright may be provided with a support on only one side or on both opposite sides of the upright. Which configuration is selected depends on whether the transfer unit is positioned only laterally of a bobbin creel or positioned between two neighboring creel rows. A reliable transfer of bobbin cases from the delivery positions onto the receptacles and from the receptacles onto the transport positions of a bobbin carrier, or a reliable transfer of full bobbins from a bobbin carrier via a transfer unit onto a creel row, are ensured by the horizontal travel of the receptacles with respect to the support. This horizontal movement can also be implemented pneumatically, electrically or hydraulically.

Each bobbin carrier is integrated in a conveyor system which has incorporated therein also the feed station for full bobbins, the storage station for bobbin carriers loaded with full bobbins, and the cleaning station for the bobbin cases. Such a conveyor system with rails represents an automatic circulation system in which full bobbins from the feed station are transported by the bobbin carriers toward the creel and there by at least one transfer unit from the bobbin carrier onto the delivery positions of the creel, whereas bobbin cases are transferred from the delivery positions onto the transport positions of the bobbin carrier. The bobbin cases are then cleaned in the cleaning station. Of course, the movement of the carriers may also be implemented by hand or semi-automatically.

The feed station may include a manually-operated handling device by which full bobbins can easily be withdrawn from a box and transferred onto a transport station of a bobbin carrier. The bobbin carrier loaded with full bobbins is then moved to a storage station and, if need be, subsequently moved from the storage station to the creel. Empty boxes are transported to a production site for bobbins.

The so-called doffing time, i.e. the period for exchange of an empty bobbin (bobbin case) with a full bobbin, including shutdown period of the textile machine, time for cutting the yarns, removing empty bobbins, positioning new bobbins, connecting the filaments and re-starting of the textile machine, can now be significantly reduced. As a consequence, the ratio between doffing time to bobbin running time is much improved and this improvement is accompanied by an absence of any physical stress for the worker. The bobbin cases as well as in particular the full bobbins are supported by the transfer unit. Thus, the weight of the bobbins, in particular of the full bobbins is now of secondary consideration. Bobbins of great diameter may be used, even further improving the relation between the doffing time to the bobbin running time.

The number of bobbin carriers is dependent on the number of delivery positions in the creel. In this way, a sufficient number of carriers with empty and full transport positions can be made available at all times. As the bobbin carrier is in overhead disposition above a creel row, the filaments are not obstructed when pulled off the delivery position onto the textile machine.

When providing a bobbin carrier with a number of transport positions in correspondence to the number of delivery positions, e.g. six superimposed delivery positions, the doffing time can be reduced to a cycle of about 1.5 to 2 min in case of 36 bobbins on each side of the creel through simultaneous removal and attachment of six bobbins by a transfer unit. Assuming a creel having three creel rows with a total of 3,240 delivery positions, the doffing time is about 135 to 180 min. Considered in this calculation is the time of stoppage of the textile machine, cutting of e.g. threads by the workers and their attachment as well as renewed tying of the threads of the full bobbins as well as starting of the textile machine.

According to another feature of the present invention, the number and distance of the receptacles in superimposed disposition on the transfer unit corresponds to the number and vertical distance of the delivery positions or transport positions. In this way, the exchange of empty bobbins with full bobbins is further accelerated.

According to another feature of the present invention, the bobbin carrier may include a framework with several vertical posts having upper and lower ends, with the upper ends of the posts being interconnected by an upper locking bar and the lower ends of the posts being interconnected by a lower locking bar. The posts and locking bars may be made of hollow square sections. Extending transversely from the posts, the bobbin carrier may include pins arranged in pairs and staggered by 180° to form the transport stations. The pins have longitudinal axes which may extend horizontally or may slightly slant upwards from the posts.

According to another feature of the present invention, the bobbin carrier may include support rollers positioned in an area above the upper bar and rotatable about horizontal axes. Suitably, two pairs of rollers may be disposed behind one another in proximity of each end of the upper locking bar. The roller pairs may be rotatable about a vertical axis so as to be able to negotiate curved sections of the travel path of the guide. The guide may have a U-shaped cross section which is open downwards and is formed with inwardly turned confronting flanges having inside surfaces for defining running surfaces for the support rollers.

According to another feature of the present invention, the bobbin carrier may include guide rollers positioned in an area below the lower bar and rotatable about vertical axes. The guide rollers roll along inner sidewalls of a downwardly open U-shaped rail which is secured above each creel row.

According to another feature of the present invention, the lower locking bar of the bobbin carrier may include cross members which are supported on running rollers, so as to allow a movement of the bobbin carrier on the ground. Suitably, the running rollers are mounted to the cross members for rotation about vertical axes.

According to another feature of the present invention, the upright is guided on both ends to move in a predetermined path. This can be implemented by securing the upright on a base plate which is supported on rollers rotatable about horizontal axes and having lateral collars for encompassing floor rails. Disposed on the upper end of the upright may be a guide roller which is rotatable about a vertical axis and projects into an downwardly open U-shaped rail.

The longitudinal movement of the upright may be realized manually, pneumatically, electrically or hydraulically.

According to another feature of the present invention, the arrangement may further include a production unit for making full bobbins, wherein the feed station is positioned upstream of the production unit in the travel path. Thus, there is no need to transfer full bobbins from boxes onto the transport positions of a bobbin carrier but the full bobbins can be directly transferred from the production unit onto the transport positions of a bobbin carrier. Hereby, the bobbin-making production unit may be provided, e.g., with lateral longitudinal conveyors and at least one transverse conveyor at one end for transporting the full bobbins to the feed station.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
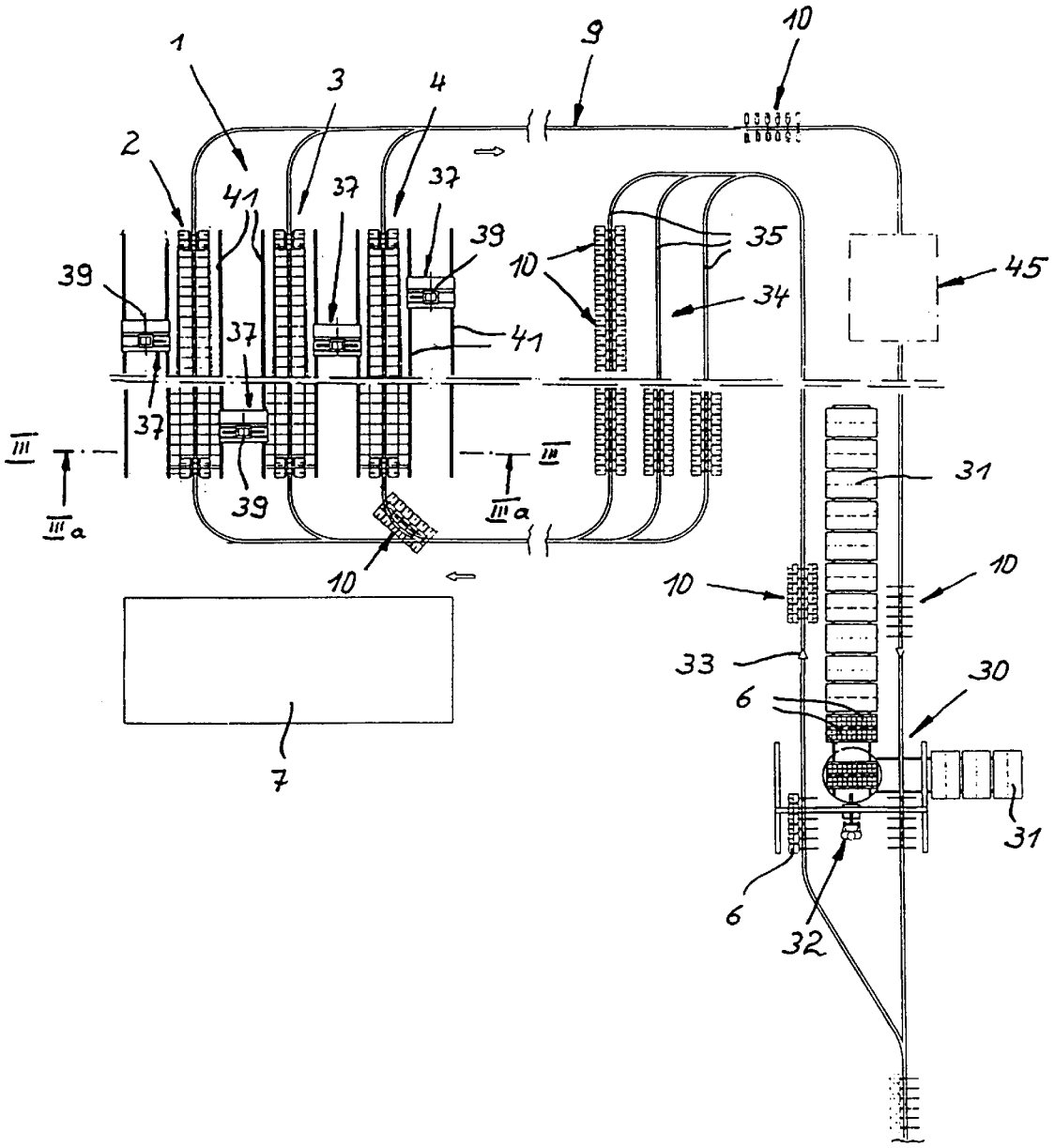
FIG. 1 is a schematic view from above of a conveyor system having integrated therein an arrangement for exchange of empty bobbins with full bobbins in a bobbin creel assembly, in accordance with the present invention.

Throughout all the Figures, same or corresponding elements are generally indicated by same reference numerals.

Turning now to the drawing, and in particular to FIG. 1, there is shown a schematic view from above of a conveyor system, generally designated by reference numeral 9 and having integrated therein an arrangement for exchange of empty bobbins 8 with full bobbins 6 in a bobbin creel assembly, generally designated by reference numeral 1. The bobbin creel assembly 1 includes three rows of creels 2, 3, 4 in side-by-side disposition. Each of the creels 2, 3, 4 has six delivery positions in superimposed disposition on both sides for holding full bobbins 6, i.e. bobbins which carry filament or yarn or thread. For sake of simplicity, the following description will generally refer to "filament" only but the principles described herein are equally applicable to yarn or thread or other like objects. As viewed in longitudinal direction of the creels 2, 3, 4, each horizontal plane is provided with ninety delivery positions 5, so that the three creels 2, 3, 4 have a total of 3,240 delivery positions 5.

Filaments from all of the creels 2, 3, 4 of the creel assembly 1 are pulled off the bobbins 6 and processed in a textile machine 7, e.g. a beamer by which the filaments are wound on a beam. It takes about 24 hours to unwind the filaments from the bobbins 6 so that the resultant empty bobbins 8 (bobbin cases) have to be removed and replaced by full bobbins 6 again. For this purpose, the creel assembly 1 is integrated in the conveyor system 9 by which empty bobbins 8 are replaced with full bobbins 8 in a comparably short period, without much physical stress to workers.

The conveyor system 9 includes several bobbin carriers 10 in overhead disposition for removing empty bobbins 8 from the creel assembly 1 and supplying full bobbins 6 to the creel assembly 1. As shown in particular in FIGS. 5 and 6, each bobbin carrier 10 includes a framework 11 having several vertical posts 12 which are interconnected at their upper ends by an upper locking bar 13 and at their lower ends by a lower locking bar 14. The posts 12 and the locking bars 13, 14 are made in the form of hollow square sections and may be connected through welding. Projecting out from the posts 12 in a transverse direction are pins 15 in paired and 180° staggered disposition for defining transport positions 16 for full bobbins 6 and empty bobbins 8.

Figure 3:
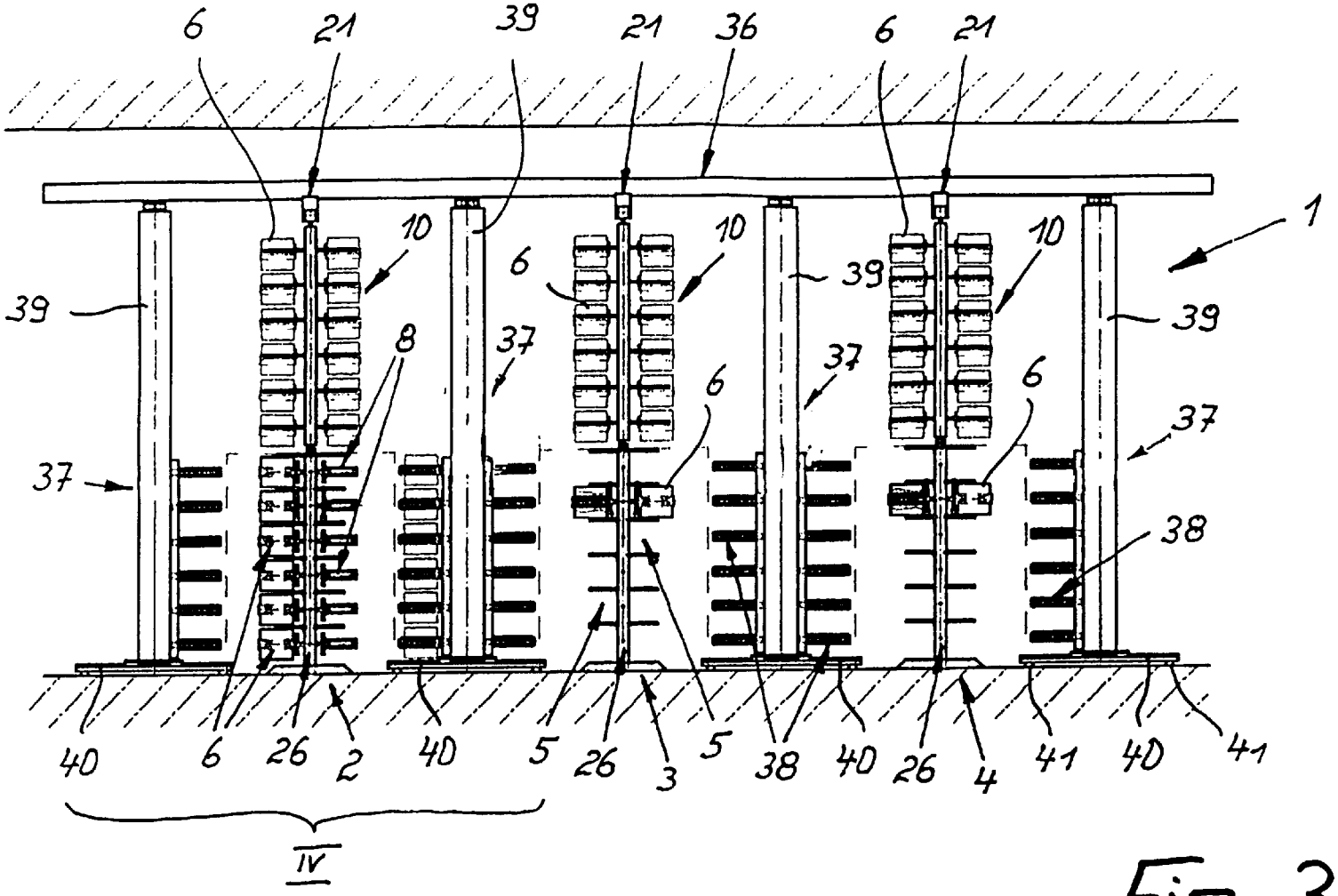
FIG. 3 is a schematic sectional view, on an enlarged scale, of the arrangement, taken along the line III—III in FIG. 1 as viewed in the direction of arrow IIIa.
Figure 4:
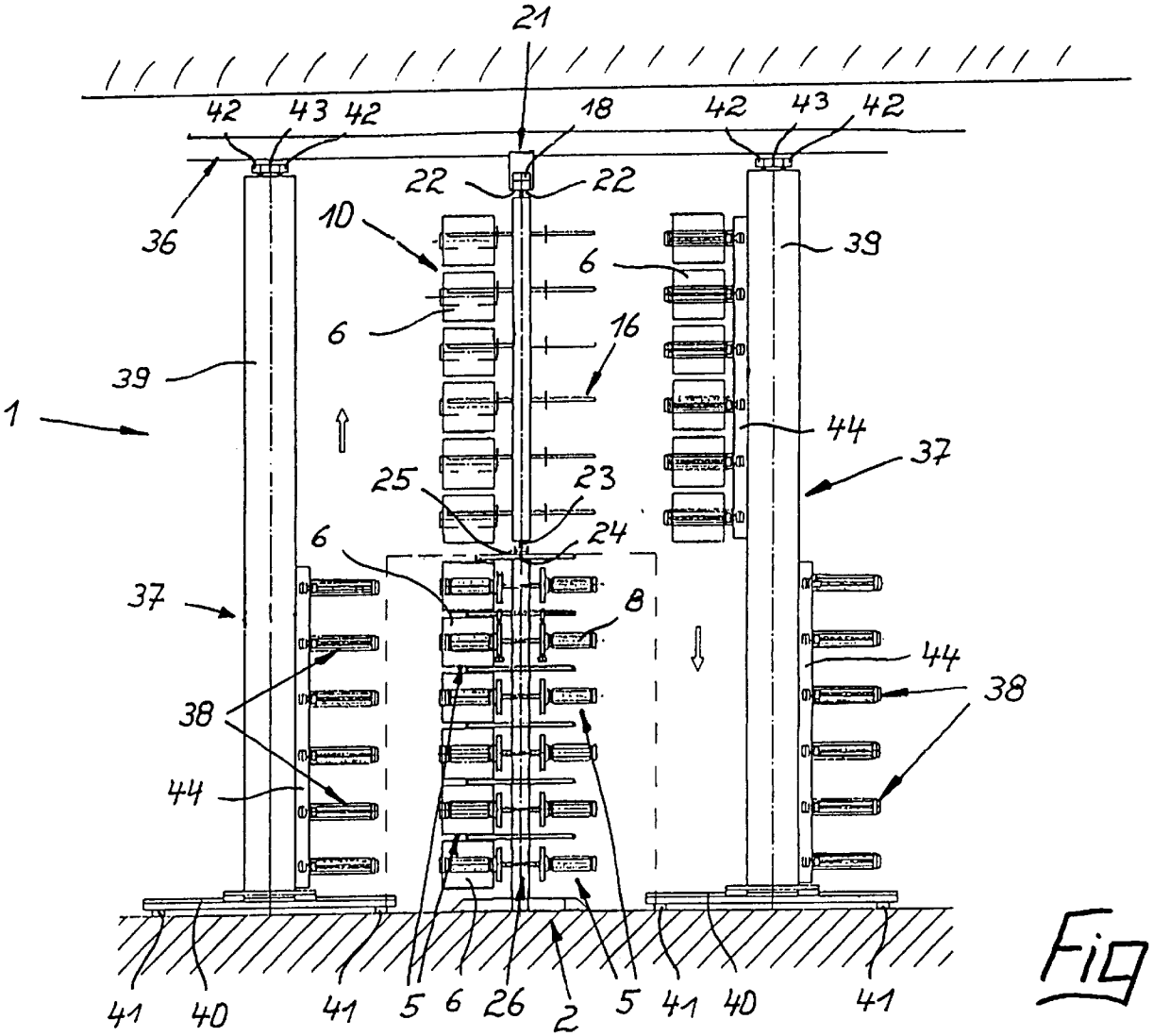
FIG. 4 is an enlarged detailed view of the area bracketed with IV in FIG. 3.
Figure 5:
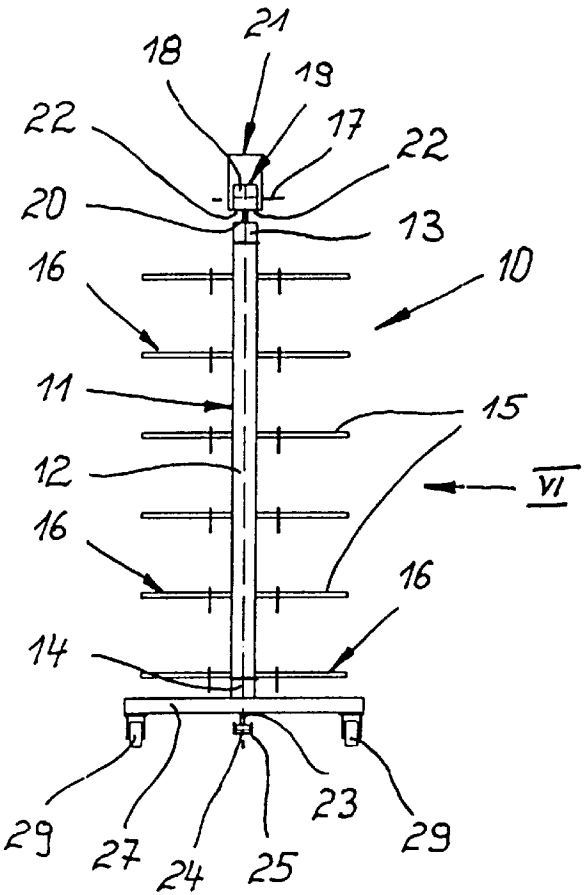
FIG. 5 is an end view of a bobbin carrier.

Each bobbin carrier 10 is provided above the upper locking bar 13 with support rollers 18 which are rotatable about horizontal axes 17. In total, four pairs of support rollers 18 are provided, with two pairs of support rollers 18 mounted to the upper locking bar 13 for rotation about a vertical axis 20. As shown in FIGS. 4 and 5, the support rollers 18 are received in a rail 21 which has an inverted U-shaped configuration and thus is open in downward direction. The rail 21 is part of the conveyor system 9 and has a lower end formed with two inwardly directed flanges 22 having inner sides to form running surfaces on which the support rollers 18 roll along. Each bobbin carrier 10 is provided below the lower locking bar 14 with guide rollers 24 which rotate about vertical axes 24. In the areas of the creels 2, 3, 4, these guide rollers 24 roll along inner sides of guide rails 25 which have an upwardly open U-shaped configuration and are arranged upon the support structures 26 of the creels 2, 3, 4, as shown in FIGS. 3 and 4. The guide rollers 24 are located approximately in the vertical cross planes in which also the vertical axes 20 of the pairs of support rollers 18 extend.

Figure 6:
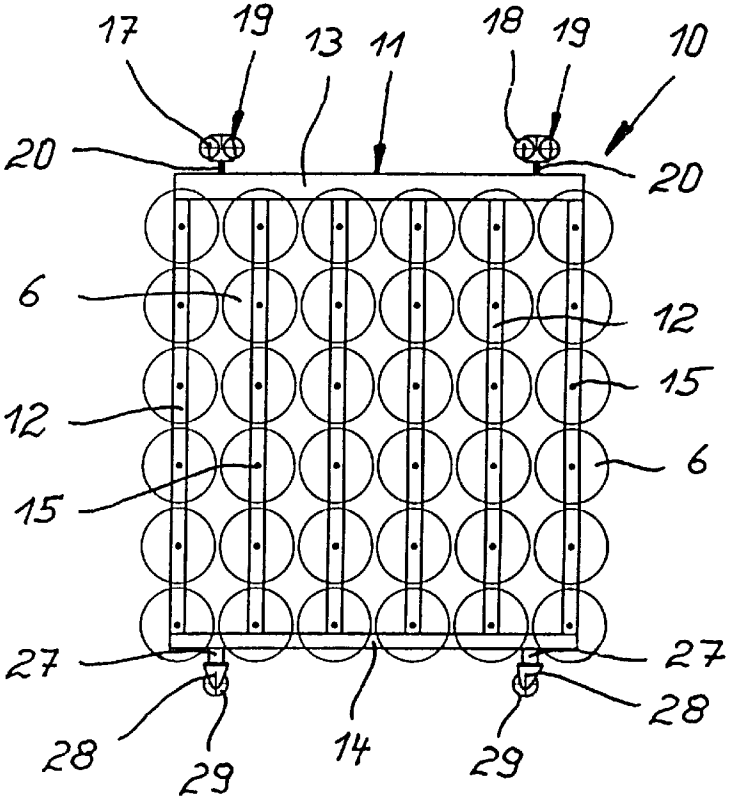
FIG. 6 is a side view of the bobbin carrier of FIG. 5, taken in the direction of arrow IV.

As shown in FIGS. 5 and 6, each bobbin carrier 10 is provided with cross members 27 below the lower locking bar 14 approximately in the area of the cross planes of the support rollers 18 and the guide rollers 24. The cross members 27 may be made of hollow square sections and are provided for attachment of running rollers 29 which are rotatable about vertical axes 28. These running rollers 29 allow an optional travel of the bobbin carriers 10 on the floor.

Referring again to FIG. 1, the arrangement includes a feed station 30, which forms at least indirectly an integral part of in the conveyor system 9, for supplying the bobbin carriers 10 with full bobbins 6. The feed station 30 includes boxes 31 which contain full bobbins 6 for transfer onto the bobbin carriers 10. The transfer of full bobbins 6 from the boxes 31 onto the transport positions 16 of the bobbin carriers 10 is implemented by a suitable handling device or manipulator 32 by which, without much physical stress, any size and weight of bobbins 6 can be pushed onto the pins 15 of the bobbin carriers 10. Structure and operation of such handling devices are generally known to the artisan and not described in detail for the sake of simplicity.

After being loaded with full bobbins 6, the bobbin carrier 10 travel in the direction of arrow 33 along the conveyor system 9 to a storage station 34 which may include several tracks 35, e.g., three, for temporary storage. Depending on need, bobbin carriers 10 can then be moved from the storage station 34 to the creels 2, 3, 4, whereby the rails 21 of the conveyor system 9 are so positioned as to run above the creels 2, 3, 4 in coincidence with the vertical center longitudinal planes of the creels 2, 3, 4, as shown in FIG. 1. Hereby, the rails 21 are mounted to a support frame 36, as shown in FIG. 3. By means of the conveyor system 9, the bobbin carriers 10 can thus be moved to each of the creels 2, 3, 4 for exchange of empty bobbins 8 with full bobbins 6.

As shown in FIGS. 3 and 4, a transfer unit 37 is disposed on each side of each of the creels 2, 3, 4 and moveable along the creels 2, 3, 4. Each transfer unit 37 includes several receptacles 38 in superimposed disposition for receiving bobbins 6 or 8. The number of and the vertical distance between receptacles 38 of each transfer unit 37 corresponds to the number of and vertical distance between delivery positions 5, adjacent the transfer unit 37, in each of the creels 2, 3, 4, as well as to the number of and vertical distance between the transport positions 16 of the bobbin carriers 10. In the nonlimiting example involved here, each transfer unit 37 has six receptacles in superimposed disposition, each creel 2, 3, 4 has six delivery positions in superimposed disposition and each bobbin carrier 10 has six transport positions in superimposed disposition.

As best seen from FIG. 4, each transfer unit 37 includes an upright 39 which extends along the creel 2, 3, 4 and is movable along a predetermined path. The upright 39 has a lower end which is mounted to a base plate 40. Disposed below the base plate 40 are, not shown, guide rollers with lateral collars, for guidance along guide rails 41. Guide rollers 42 in paired disposition are mounted to the upper end of the upright 39 and roll along a vertical skirt of a guide rail 43 which is secured to the support frame 36.

The receptacles 38 for the bobbins 6, 8 of each upright 39 form part of a strip-shaped support 44 which is moveable in vertical direction along the upright 39, with the receptacles 38 being moveable in horizontal direction relative to the support 44.

An exchange of empty bobbins 8 with full bobbins 8 is as follows: After the filaments have been pulled off the bobbins 6 by the textile machine 7, the ends of the filaments are fixed locally. Then, a bobbin carrier 10 with empty transport positions 16 is moved to the creel 2, 3, 4 that requires an exchange of bobbins. The respective transfer unit 37 at that creel 2, 3, 4 picks up the empty bobbins (bobbin cases) 8 from the delivery positions 5 and moves them upwardly for transfer of the empty bobbins 8 onto the transport positions 16 of the bobbin carrier 10. This operation is repeated until the bobbin carrier 10 is fully loaded with empty bobbins 8. Thereafter, the bobbin carrier 10 travels along the rail 21 of the conveyor system 9 to a, for example, cleaning station 45, indicated in FIG. 1 only schematically by dashdot line, in which the empty bobbins 8 are removed from the bobbin carrier 10. The empty bobbin carrier 10 travels then to the feed station 30 for receiving full bobbins 6. As the bobbin carrier 10 with empty bobbins 6 travels along the rail 21 in the manner described, another bobbin carrier 10 loaded with full bobbins 6 is moved in the meantime from the storage station 34 to the creel assembly 1 to the location from which previously the empty bobbins 8 have been removed from the delivery positions 5. The respective transfer unit 37 picks up the full bobbins 6 from the bobbin carrier 10, moves them downwards and loads the full bobbins 6 onto the delivery positions of the respective creel 2, 3, 4 of the creel assembly. After exchange of a particular number of bobbins 6, 8 by the transfer unit 37, the filament end of the full bobbins 6 can be tied to the previously secured filament end of the previously unwound bobbins.

Figure 2:
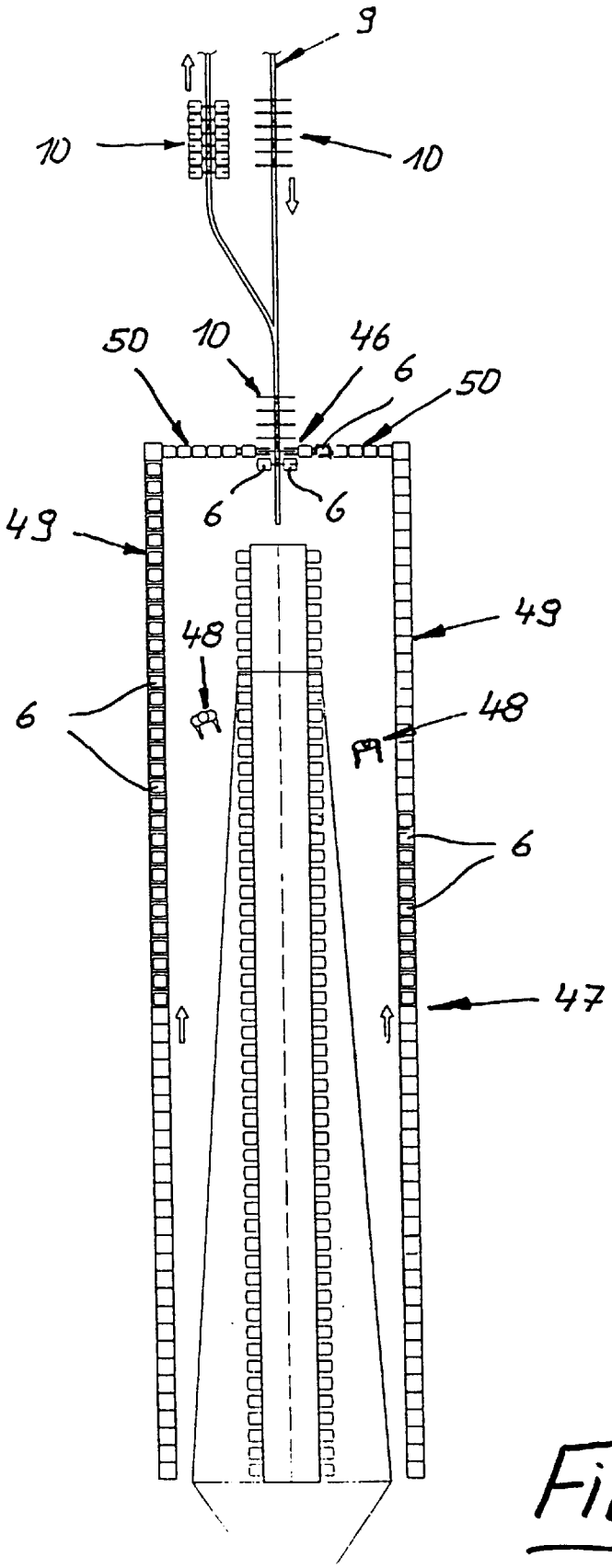
FIG. 2 is a schematic illustration of a production unit for making full bobbins for attachment to the conveyor system.

Turning now to FIG. 2, there is shown another embodiment of an arrangement for exchange of empty bobbins 8 with full bobbins 8. In this embodiment, provision is made for the provision of a production unit 47 which fabricates full bobbins 8 and is linked directly to a feed station 46. The full bobbins 6 made in the production unit 47 are moved by an operator 48, possibly with the aid of a handling device, laterally onto longitudinal conveyors 49, positioned in parallel relationship to the production unit 47, for transfer of full bobbins 6 to transverse conveyors 50, positioned at one end of the production unit 47. The transverse conveyors 50 lead to the feed unit 46 by which the full bobbins 6 are pushed onto empty transport positions 16 of a bobbin carrier 10. From there, the full bobbin carrier 10 travels to the storage station 34 and eventually to the creel assembly 1.

While the invention has been illustrated and described as embodied in an arrangement for exchange of empty bobbins with full bobbins in a bobbin creel, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and their equivalents:

1. Arrangement for exchanging empty bobbins with full bobbins; comprising:

a creel assembly including rows of creels which have lateral delivery positions for holding filament-carrying bobbins;

a textile machine receiving filament from the creel assembly;

at least one bobbin carrier disposed in overhead relationship to the creel assembly and having several transport positions for bobbins;

a guide system having a guide rail for travel of the bobbin carrier in suspended disposition along a travel path;

a bobbin transfer assembly having a moveable transfer unit disposed on one side of the rows of creels and a moveable transfer unit disposed on the other side of the creel row, each of the transfer units including an upright moveable along the creel row and at least one support moveable along the upright and having receptacles for the bobbins, wherein the receptacles are moveable in a horizontal direction with respect to the support, wherein the delivery positions in the creel row in neighboring disposition to the transfer units are provided at a number and at distance which corresponds to a number of and a vertical distance of the transfer units as well as a number of and distance which corresponds to the transport positions on the bobbin carrier;

a feed station disposed in the travel path for supply of full bobbins;

a storage station disposed in the travel path for storing carrier bobbins loaded with full bobbins; and a cleaning station for cleaning empty bobbins.

2. The arrangement of claim 1, wherein the receptacles are arranged in superimposed relationship in the transfer unit at a number and distance which corresponds to a number and vertical distance of delivery positions and transport positions.

3. The arrangement of claim 1, wherein the bobbin carrier includes several vertical posts having upper and lower ends, with the upper ends of the posts being interconnected by an upper locking bar and the lower ends of the posts being interconnected by a lower locking bar, the bobbin carrier further including pins arranged in pairs and spaced from one another by an angular distance of 180° and extending transversely from the posts to form the transport positions.

4. The arrangement of claim 3, wherein the bobbin carrier includes support rollers positioned in an area above the upper locking bar and rotatable about horizontal axes.

5. The arrangement of claim 3, wherein the bobbin carrier includes guide rollers positioned in an area below the lower bar and rotatable about vertical axes.

6. The arrangement of claim 3, wherein the lower locking bar of the bobbin carrier includes cross members supported on running rollers.

7. The arrangement of claim 1, wherein the upright is guided on both ends to move in a predetermined path.

8. The arrangement of claim 1, and further comprising a production unit for fabricating full bobbins, wherein the feed station is positioned upstream of the production unit in the travel path.

9. Apparatus for exchanging empty bobbins with full bobbins, comprising: a creel having delivery positions and configured for holding filament-carrying bobbins; an overhead conveyor system; a bobbin carrier suspended from the conveyor system guided for movement along a travel path above the creel; and transfer units positioned next to the creel and configured for transferring bobbins between the creel and the bobbin carrier superimposed above the creel, wherein the transfer units each include an upright moveable along the creel and having a support moveable along the upright and having receptacles for bobbins, with the receptacles moveable horizontally relative to the support and wherein the receptacles are arranged in superposed relationship in the transfer units at a number and distance which corresponds to a number and vertical distance of the delivery positions adjacent the transfer unit of the creel as well as to the number of and vertical distance between the transfer positions of the bobbin carrier.

* * * * *